United States Patent [19]

Berry

[11] Patent Number: 5,060,376

[45] Date of Patent: Oct. 29, 1991

[54] ELECTRIC SHAVER CLEANING MEANS AND METHOD

[76] Inventor: Gerald W. Berry, R.R. #1, Box 125, Maynard, Iowa 50655

[21] Appl. No.: 660,297

[22] Filed: Feb. 22, 1991

[51] Int. Cl.[5] ..... B26B 19/44

[52] U.S. Cl. ..... 30/41; 30/90

[58] Field of Search ..... 30/41, 41.6, 43.4, 43.7, 30/90

[56] References Cited

U.S. PATENT DOCUMENTS 3,171,567 3/1965 Somers et al. ..... 30/90
3,341,887 9/1967 Tolmie ..... 30/90
3,486,225 12/1969 Regan ..... 30/41
3,753,846 8/1973 Trouilhet ..... 30/90

*Primary Examiner*—Frank T. Yost
*Assistant Examiner*—Hwei-Siu Payer
*Attorney, Agent, or Firm*—Zarley, McKee, Thomte, Voorhees & Sease

[57] ABSTRACT

An electric shaver cleaning device assists in removal of whiskers from an electric shaving head. A pad having characteristics of being somewhat rigid yet somewhat shock absorbing is positioned on the shaver body opposite from the shaving head. The shaver is then tapped against a solid object on its pad. The force of the tapping is transmitted through the shaver body to the shaving head to dislodge whiskers which can then be easily removed without substantial brushing or other help.

16 Claims, 1 Drawing Sheet

ELECTRIC SHAVER CLEANING MEANS AND METHOD

BACKGROUND OF THE INVENTION a. Field of Invention

The present invention relates to electric shavers, and in particular, a means and method for cleaning the shaving head of an electric razor.

b. Problems in the Art

A wide variety of electric razors or shavers are available commercially. Most include a body or shell which houses an electric motor, which is either battery powered or powered through an electrical cord to a standard household electrical plug. The housing would also contain mechanical linkages from the motor to a shaving head.

The shaving head would contain the mechanism for rotating, reciprocating, or otherwise moving one or more blades past a screen. As the screen is moved over the user's beard, the whiskers enter openings in the screen and are severed by the operating blade.

As is well known, the nature of whiskers and the shaving process, as well as the structure of the shaver itself, makes the shaver difficult to clean. The severed portions of the whiskers are small, tend to adhere to the inside of the shaver head, or become lodged into small spaces formed by the parts of the shaver.

Typically, an electric shaver is cleaned by hinging or removing the shaving head and utilizing a brush to sweep out the shaved whiskers. Many times the user will blow on the shaver or shaver head using the air pressure to attempt to dislodge whiskers.

Because of the electrical nature of such shavers, the fragility of the inner components of the shaver, and the aversion of metal components of the shaver to water, rinsing the shaver off with water is rarely a viable or reasonable option.

If a razor is not properly cleaned, it can affect its performance. Even a relatively small amount of non-dislodged whiskers can be significant, or at least can complicate or exacerbate removal of whiskers at a later time. Therefore, there is room for improvement in the ability to effectively clean shaved whiskers from electric razors.

Many electric shaver users, frustrated by the inability to effectively clean razors, turn the razor off and then gently tap or knock the razor against their hands, or merely shake the razor in the air. Some also directly knock the razor against a more rigid object. This of course, can be dangerous to the operability of the shaver because of both electrical and mechanical components of the razor. Such techniques are therefore not encouraged, even though they can be very effective in dislodging whiskers.

It is therefore a principal object of the present invention to provide an electric shaver cleaning means and method which solves or improves over the problems and deficiencies in the art.

Another object of the present invention is to provide a means and method as above described which enhances the ability to clean an electric razor.

A still further object of the present invention is to provide a means and method as above described which improves the ability to clean a razor while at the same time minimizes any risk of damage to the electric razor.

Another object of the invention is to provide a means and method a above described which minimizes the time needed to clean an electric razor.

Another object of the present invention is to provide a means and method as above described which is economical, simple, durable, and efficient.

These and other objects, features, and advantages of the present invention will become more apparent with reference to the accompanying specification and claims.

SUMMARY OF THE INVENTION

The present invention includes a means and method for facilitating more effective cleaning of an electric razor. The means includes a pad member attachable to the body of a shaver generally opposite the shaving head. The pad member is somewhat rigid, but has shock absorbing qualities. The user can tap the pad on the razor, instead of the razor itself, against a rigid or solid object to translate mechanical vibrations to the razor head to effectively dislodge the severed whiskers in the head. The pad member minimizes any risk of damage to the razor, either the external components or the internal components.

The method involves lightly tapping the pad member with an attached somewhat shock absorbing pad member opposite the razor head, onto a surface or against an object. The tapping is with a force sufficient enough to generate mechanical vibrations in the razor head but less than any force which can seriously risk damage to any component of the razor. For optional cleaning, the pad is tapped against an object while the razor is operating with the head in operating position. The pad member is positioned generally opposite the shaving head and the tapping is completely generally along an axis between the razor head and the member. The method can reduce any other steps required to clean the razor head and may even eliminate the need for brushing the head or blowing on the razor head.

DESCRIPTION OF THE PREFERRED EMBODIMENT

In order to achieve a better understanding of the invention, a detailed description of two preferred embodiments of the present invention will now be set forth. It is to be understood that this detailed description is solely with respect to examples of forms the invention may take, and is not inclusive.

This detailed description will include reference to the drawings. Reference numbers on the drawings designate certain parts and locations on the drawings. The same reference numbers will be used to indicate the same or similar parts and locations in both drawings unless otherwise indicated.

It is believed to be easy to appreciate that an electric razor is not easy to thoroughly clean. As previously described, some of the difficulties are the result of the structure and nature of an electric razor, whereas other factors include limitations on what can be used to clean electric razors.

Figure 1:
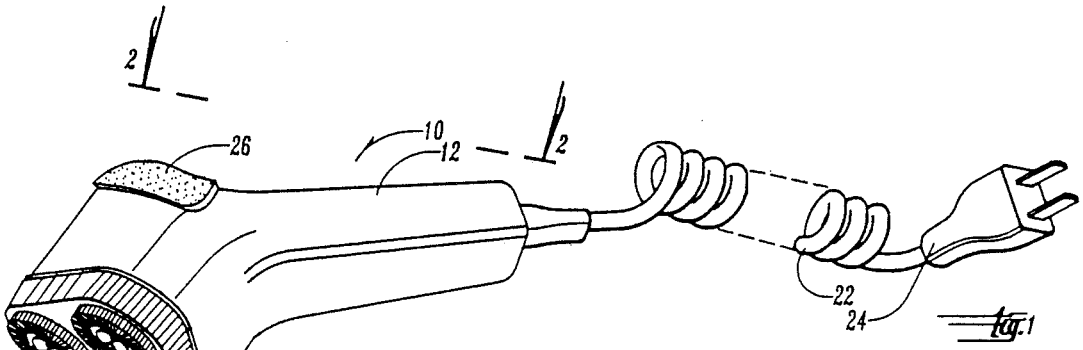
FIG. 1 is a perspective view of one embodiment of the invention in place on one type of an electric razor.
Figure 2:
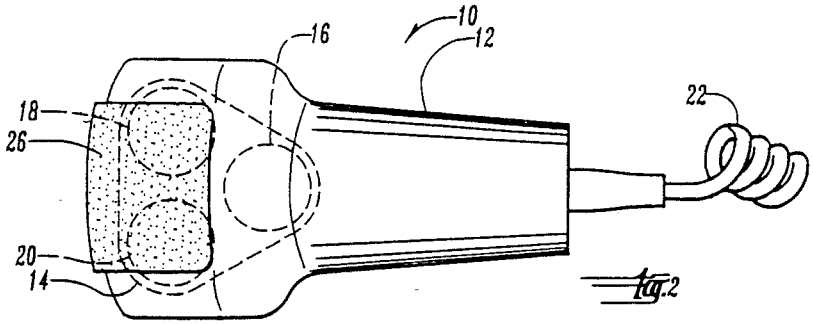
FIG. 2 is a plan view taken along line 2—2 of FIG. 1.

Referring to FIGS. 1 and 2, an electric razor 10 (available from Norelco, USA) is shown in perspective. Razor 10 includes a body 12 which houses an electric motor and mechanical linkage, as well as other components (not shown). Razor 10 also includes a shaving head 14, which in this embodiment includes three blade screens 16, 18 and 20 which surround rotating blades (not shown).

Razor 10 is electrically powered by connecting cord 22 and plug 24 to a normal household electrical plug. As is well known, by operating appropriate switch(es), the razor is turned on, the motor inside body 12 rotates and transfers rotational power to the blades within screens 16, 18, and 20 . Shaving head 14 is then moved across the user's beard, whiskers enter the openings in screens 16, 18 and 20, and the blades cut the whiskers off. The whiskers then collect inside the shaving head 14.

In this particular embodiment of razor 10, shaving head 14 is hingeable and removable from body 12. A conventional manner of cleaning whiskers from shaving head 14 is to shut the razor off, either hinge or remove head 14, and empty the whiskers. Sometimes a brush is used to facilitate their removal; sometimes the head is gently tapped against the hand with the head hinged open or removed. Furthermore, sometimes the blades and screens are disassembled to thoroughly clean the head 14.

In the embodiment of FIGS. 1 and 2, a member 26 is attached to body 12. Member 26 is preferably a pad or similar piece made from somewhat rigid but somewhat shock absorbing material such as a harder type rubber. It is important to note that member 26 is affixed to body 12 generally opposite from the position of shaving head 14. In the preferred embodiment member 26 is a hard rubber and is attached to body 12 by an adhesive.

The addition of member 26 therefore allows the user, after shaving, to physically tap electric razor 10 against a hard or rigid surface. This may be done when shaving head 14 is in the position shown in FIG. 1. The physical tapping transfers mechanical vibrations through body 12 to the location of shaving head 14, which in turn comprises a force which can dislodge and loosen whiskers in, on and around shaving head 14. Once dislodged, whiskers easily fall from the shaver when head 14 is hinged open or removed. At a minimum the whiskers are easier to remove. Such force overcomes any adhesion to parts of the razor or other whiskers, or dislodges the whiskers from small or tight locations.

This process of cleaning the razor can substantially reduce additional steps needed for cleaning. In fact, it can completely eliminate the need to brush or blow on the razor head, or inside the razor head. If done routinely, it can maintain the cleanliness of the interior of the shaving head 14, and facilitate the removal of whiskers, which assists in maintaining the level of operability of the razor as much as possible.

To enhance and optimize cleaning performance of the invention, the razor is actually operated while it is tapped on pad 26. Shaving head 14 is secured in its position shown in FIG. 1, and the blades within blade screens 16, 18, and 20 are rotating. Razor 10 needs to be tapped only two or three times on pad 26 during operation to effectively dislodge and loosen whiskers within the shaving head 14. This procedure only takes a few seconds, but results in the ability to thoroughly clean the razor with generally no other actions.

It is further to be understood that pad 26 provides a readily discernible indicator as to where the razor head should be tapped. It allows the user to obtain the most effective cleaning by insuring that the tapping will occur generally opposite the shaving head 14 on the body 12 of razor 10.

Figure 3:
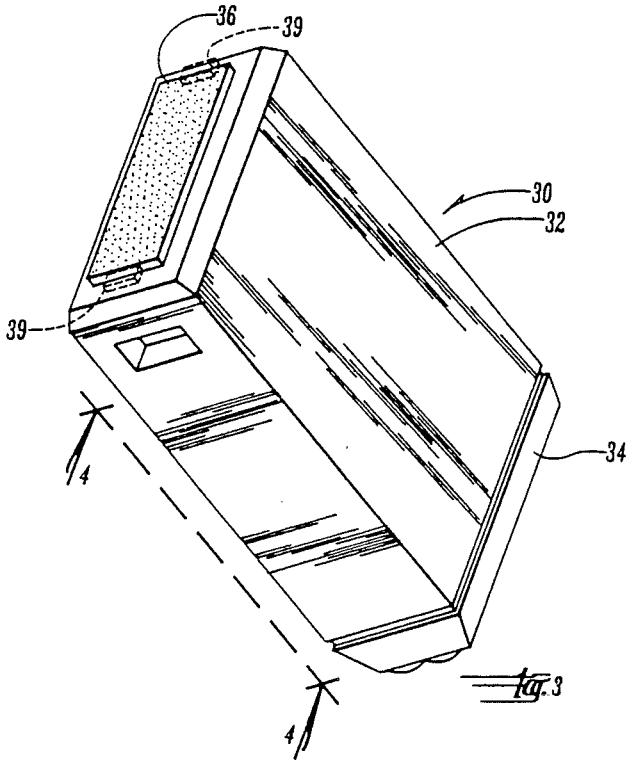
FIG. 3 is an alternative embodiment of the invention on a different type of electric razor.
Figure 4:
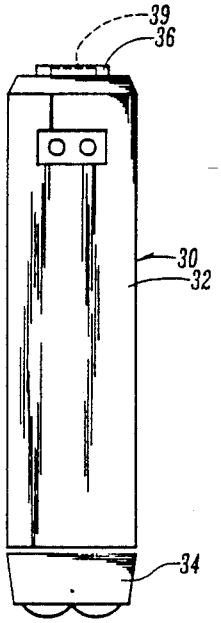
FIG. 4 is a side view taken along line 4—4 of FIG. 3.

FIGS. 3 and 4 depict a different embodiment of an electric razor 30. In this embodiment, razor 30 has a body 32 and a razor head 34. As is well known in the art, razor 30 is electric, but is battery powered and therefore does not need an electrical cord or plug. It could be an electric razor available from Remington, USA.

In the embodiment of electric razor 30, member 36 (similarly consisting of the somewhat rigid yet somewhat shock absorbing qualities) is secured to body 32. Its position, again, is generally on body 32 opposite the position of razor head 34. The same general steps are utilized in cleaning the razor. Member 36 of razor 30 can be tapped gently against a hard or rigid surface which in turn transmits vibrations to razor head 34 to assist in dislodging and removing whiskers.

A process of cleaning razor 30 again involves the operation of razor 30 for the two seconds or so while pad 36 is tapped against an object. Once the two or three taps are completed, razor head 34 is opened to allow the dislodged and loose whiskers to fall out. Again, pad 36 can be made to visually or otherwise indicate the location for tapping of razor 30. The cleaning is accomplished with a couple of taps over a couple of seconds. This can be directly compared with cleaning methods presently known in the art.

As can be seen, the embodiments illustrate a structure which allows the tapping of the razors to greatly diminish risk of any damage to any portion of the razors. It also eliminates other cumbersome and time-consuming steps, such as disassembly, brushing, or other cleaning techniques.

It can therefore be seen that the invention achieves at least all of its stated objectives. It will be appreciated that the present invention can take many forms and embodiments. The true essence and spirit of this invention are defined in the appended claims, and it is not intended that the embodiments of the invention presented herein should limit the scope thereof.

It should be understood, for example, that members 26 and 36 could be made of other materials such as wood, or any material having the described qualities of being somewhat rigid and somewhat shock absorbing. Generally, it is preferred that the material, or any covering of the material making the pad member, be of a type or makeup which does not mark or scratch when tapped, but is durable to stand up to many uses. Also, a variety of different ways could be utilized to attach members 26 or 36 to the body of a razor. Different adhesives (see dashed line 37 in FIG. 4) could be utilized, or even hardware such as screws, bolts, or brackets (see dashed lines 39 in FIG. 3, for example).

The invention should work with most types of electric razors. The method of cleaning usually requires only two or three taps to sufficiently dislodge the whiskers so that they can be easily disposed of. In the preferred embodiment in FIG. 1, the tapping pad is approximately one and a quarter inch by three quarter inch by one quarter inch. In the embodiment of FIG. 2, the pad can be larger, spanning the width of the shaver and being perhaps several inches long.

The applicability of the present invention has been shown by the following tests. A Norelco razor similar to that shown in FIG. 1 has been used repeatedly to shave the inventor's beard. Shaving head 14 is then hinged open and whiskers in the shaving head 14 are dumped out. Shaver is then turned back on and tapped against an object at pad 26 for two or three taps. The shaver is then turned off, the head 14 opened, and additional whiskers fall out. This illustrates that the invention facilitates the dislodging and loosening of whiskers otherwise not apt to be dislodged or loosened.

What is claimed is:

1. A means for facilitating cleaning of an electric shaver, where the electric shaver includes a body portion and a shaving head portion, the improvements comprising: a pad means attached to the body portion of the electric shaver generally opposite the shaving head of the electric shaver.

2. The means of claim 1 wherein the pad means is attached to the body portion by a mounting means.

3. The means of claim 2 wherein the mounting means comprises adhesive means.

4. The means of claim 3 wherein the mounting means comprises bracket means.

5. The means of claim 1 wherein the pad means is made from a material which is somewhat rigid and somewhat shock absorbing.

6. The means of claim 5 wherein the pad means is made of a hard rubber material.

7. The means of claim 1 wherein the pad means is made of wood.

8. The means of claim 1 wherein said pad means includes means which is visually distinct from the shaver.

9. The means of claim 1 wherein said pad means includes means which is tactilely distinct from the shaver.

10. A method for facilitating cleaning of an electric shaver comprising:

(a) attaching a pad means generally opposite from a shaving head of the shaver;

(b) tapping the shaver on a generally solid object by bringing the pad into contact with the generally solid object;

(c) transmitting the force of the tapping to the shaving head to dislodge whiskers in the shaving head;

(d) emptying the dislodged whiskers from the shaving head and shaver.

11. The method of claim 10 further comprising the step of operating the shaver with the shaving head in an operating position while tapping the shaver.

12. The method of claim 11 further comprising opening the shaving head after tapping to dump whiskers from the shaver.

13. The method of claim 10 further comprising tapping the shaver only several times over only several seconds.

14. The method of claim 10 further comprising making the pad means visually distinguishable from the shaver to identify the location for tapping.

15. The method of claim 10 further comprising making the pad means tactilely distinguishable from the shaver to identify a location for tapping.

16. A means for facilitating cleaning of an electric shaver, where the electric shaver includes a body portion and a shaving head portion, the improvement comprising: a pad means attached to the body portion of the electric shaver, the pad means being made of wood.

* * * * *